US008240495B2

(12) United States Patent
Ronci et al.

(10) Patent No.: US 8,240,495 B2
(45) Date of Patent: Aug. 14, 2012

(54) CONTAINER INTERNAL LOCK MECHANISM

(75) Inventors: Wayne L. Ronci, Omaha, NE (US); Adrian Hernandez, Los Angeles, CA (US)

(73) Assignee: Union Pacific Railroad Company, Omaha, NE (US)

( * ) Notice: Subject to any disclaimer, the term of this patent is extended or adjusted under 35 U.S.C. 154(b) by 270 days.

(21) Appl. No.: 12/652,394

(22) Filed: Jan. 5, 2010

(65) Prior Publication Data

US 2011/0162418 A1 Jul. 7, 2011

(51) Int. Cl.
*B65D 6/28* (2006.01)
*B65D 45/16* (2006.01)

(52) U.S. Cl. ..... 220/4.33; 220/326; 220/1.5

(58) Field of Classification Search ..... 220/4.33, 220/4.28, 326, 324, 315, 1.5, 833, 810, 827; 70/91, 266, 431, 77; 206/509, 504, 503; 217/57, 56, 36; *B65D 45/16, 6/28; E05B 65/06, E05B 65/00, 15/00, 17/00*

See application file for complete search history.

(56) References Cited

U.S. PATENT DOCUMENTS 3,691,595 A * 9/1972 Backteman et al. ..... 24/287
3,980,185 A * 9/1976 Cain ..... 206/509
4,360,115 A * 11/1982 Saunders ..... 220/1.5
5,722,328 A * 3/1998 Darby ..... 108/55.1
6,415,938 B1 * 7/2002 Karpisek ..... 220/1.5
2003/0214143 A1 * 11/2003 Walker ..... 294/81.53
2006/0043090 A1 * 3/2006 Ferrini ..... 220/6

FOREIGN PATENT DOCUMENTS

CN 201367208 Y 12/2009
CN 201367211 Y 12/2009
CN 201381074 Y 1/2010
CN 101734449 A 6/2010
CN 201520506 U 7/2010

* cited by examiner

*Primary Examiner* — Mickey Yu
*Assistant Examiner* — Robert J Hicks
(74) *Attorney, Agent, or Firm* — Pillsbury Winthrop Shaw Pittman LLP

(57) ABSTRACT

Internal lock mechanisms for doors of intermodal containers. The lock mechanisms include a lock member that moves between a locked position engaging a door to lock the door in the closed position and an unlocked position disengaged from the door to permit the door to move from the closed position to the open position. At least a portion of the lock mechanism is provided within or adjacent to the sill. In one instance, the lock member is biased toward the locked position, and a contact portion on a bottom of the container is contacted to unlock it. The lock mechanism may be accessed via connection openings in a corner fitting, for example. In another instance, hooks and hook receiving members are provided within an interior of the container, and rotated along a rotatable shaft between the two positions.

20 Claims, 9 Drawing Sheets

CONTAINER INTERNAL LOCK MECHANISM

BACKGROUND

1. Field of Invention

The present invention is generally related to providing an internal locking mechanism for locking doors of containers.

2. Description of Related Art

When transporting goods or products in containers (such as intermodal containers) via a railway system, the doors to the containers are usually locked to prevent access to the contents therein via accident or theft. Often, external locking devices are provided to lock the doors. FIG. 1 illustrates an example of an external locking device. However, these locking devices may not necessarily deter access to the contents within the container. Also, at times, external locks may be accidentally damaged (e.g., by contact with another container) when moving or stacking, for example.

SUMMARY

One aspect of the present invention provides an intermodal container having: at least a top wall, a bottom wall, side walls, at least one door and a sill adjacent a bottom end of the at least one door. The at least one door is movable between an open position and a closed position. An internal lock mechanism is provided for the at least one door, and has a lock member configured to move between (a) a locked position engaging the at least one door to lock the at least one door in the closed position and (b) an unlocked position disengaged from the at least one door to permit the at least one door to move from the closed position to the open position. The lock member is biased toward the locked position. At least a portion of the internal lock mechanism is provided within the sill of the intermodal container. The internal lock mechanism further includes a contact portion for moving the lock member between the locked position and the unlocked position. The contact portion is accessible via an opening on a bottom of the container. The contact portion is configured such that contact with the contact portion by a contacting structure of an object upon which the container stacks responsively moves the lock member against its bias from the locked position to the unlocked position, thereby permitting movement of the at least one door of the intermodal container from the closed position to the open position.

Another aspect of the invention provides a method for unlocking a door of an intermodal container, the intermodal container having at least a top wall, a bottom wall, side walls, at least one door and a sill adjacent a bottom end of the at least one door. The at least one door is movable between an open position and a closed position. An internal lock mechanism is provided for the at least one door, and has a lock member configured to move between (a) a locked position engaging the at least one door to lock the at least one door in the closed position and (b) an unlocked position disengaged from the at least one door to permit the at least one door to move from the closed position to the open position. The lock member is biased toward the locked position. At least a portion of the internal lock mechanism is provided within the sill of the intermodal container. The internal lock mechanism further includes a contact portion for moving the lock member between the locked position and the unlocked position. The contact portion is accessible by a contacting structure of an object via an opening on a bottom of the container. The method for unlocking the door includes: stacking the container on the object; contacting via the opening the contact portion of the internal lock mechanism using the contacting structure, and moving the lock member from the locked position to the unlocked position, thereby permitting movement of the at least one door of the intermodal container from the closed position to the open position.

Yet another aspect of the invention provides an intermodal container having: at least a top wall, a bottom wall, side walls, at least one door and a sill adjacent a bottom end of the at least one door. The at least one door is movable between an open position and a closed position. An internal locking mechanism is provided for the at least one door, and has a lock member configured to move between (a) a locked position engaging the at least one door to lock the at least one door in the closed position and (b) an unlocked position disengaged from the at least one door to permit the at least one door to move from the closed position to the open position. A movable portion of the internal lock mechanism is provided adjacent to the sill and within the interior of the intermodal container. The internal lock mechanism further includes a plurality of hooks and a plurality of hook receiving members for interengaging one another. The plurality of hooks and the plurality of hook receiving members are provided within the interior of the intermodal container on the movable portion and the at least one door. The movable portion is movable between (a) a locked position interengaging the hooks and hook receiving portions to lock the at least one door in the closed position and (b) an unlocked position disengaging the hooks and the hook receiving portions. Also, an activation mechanism for moving the movable portion between the unlocked position and the locked position is provided.

Other objects, features, and advantages of the present invention will become apparent from the following detailed description, the accompanying drawings, and the appended claims.

DETAILED DESCRIPTION OF THE PREFERRED EMBODIMENT(S)

It is a goal of the present invention to provide an internal, mechanical lock mechanism, for at least one door of a container, that is biased towards a locked position when the door is closed. Generally, the internal lock mechanism(s) are designed such that they prevent opening of the doors and access to the contents in the containers (e.g., by intruders or thieves), such as during transportation or storage. The internal lock mechanism may be automatically unlocked to an unlocked position through contact with a contact portion by a contacting structure of an object. Such a contacting structure may be a twist lock that is used with a chassis, for example. In this case, "automatically" unlocking the lock mechanism refers to moving the mechanism to an unlocked position when contact is made with a contact portion of the lock mechanism. For purposes of this disclosure, a "chassis" is defined as an under frame device on which a container is mounted for transport, such as through a rail yard or intermodal terminal, for example. Additional features and advantages to the internal lock mechanism will become evident throughout the description below.

In some embodiments, the internal lock mechanisms disclosed herein are provided in intermodal containers. Though intermodal containers are designed to be used in more than one form of transportation, e.g., railway, waterway, or highway, the embodiments below are herein described pertaining to their use on a railway.

Figure 1:
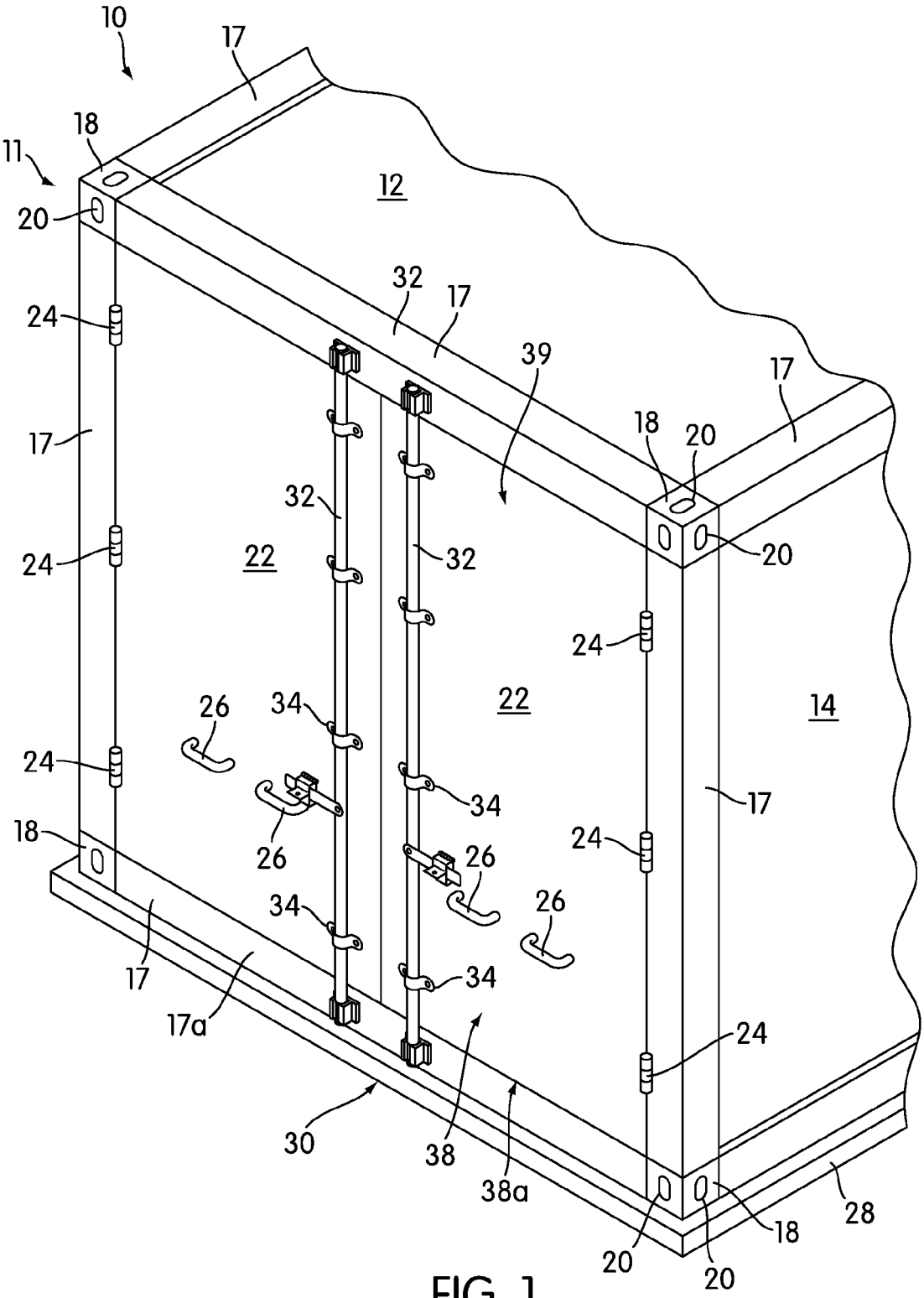
FIG. 1 PRIOR ART
FIG. 1 is a perspective view of an end of a container with doors and corresponding locking bars located on an exterior of the container in accordance with the prior art.

Referring now more particularly to the drawings, FIG. 1 illustrates an end 11 of a container 10. A "container" is herein defined as a receptacle for holding goods or contents or cargo, and is designed to be moved by at least one form of transportation. A container 10 may be lifted and mounted onto flatcars, well cars, stack cars, gondola cars, or any other type of rail car. For example, it is noted that a container, as herein described, may be defined as a box container, bulk container, tank, or other storage device. Containers may comprise a structure or frame that allows for stacking and mounting on top of one another. Generally such containers are also referred to as "ISO containers," as they are manufactured according to specifications from the International Standards Organization (ISO) and are suitable for multiple transportation methods such as truck and rail, or rail and ship. For example, a known standard for such containers is ISO 1496. Also, it is noted that container 10 may be an EMPU intermodal container (i.e., a container which is 48 feet in length) or an EMRU or EMHU intermodal container (i.e., a container that is 53 feet in length) that is used for domestic container service, such as the EMP domestic container program service offered by Union Pacific and Norfolk Southern Railway Companies, for example.

Also, it is noted that the end 11 of the container 10 as described should not be limiting. For explanatory purposes only, the end 11 of the container 10 will be referred to as a back end of the container. However, the doors 22 and the elements described with respect to the container 10 may also be provided on the front end of the container. Also, one or more doors 22 and features may also be provided on a side of a container 10. Furthermore, additional features or elements may also be provided on an end 11 of a container 10 and therefore the description should not be limiting.

The container as described herein may comprise various sizes and features. As generally known in the art, the side walls 14 may comprise one or more doors or openings allowing access to contents being held therein. The one or more doors 22 may be provided on a back wall (as shown and described in this disclosure), near the rear of the container, near the front of the container, on the sides of the container, or even a top of the container. Alternatively, a top wall of a container may not be included. Such features as described with respect to the containers should not be limiting. The dimensions or sizes of the containers should also not be limiting. For example, standard ISO intermodal shipping containers comprising dimensions of 10 to 53 feet long, 8 feet to 9 feet 6 inches high, and 8 feet wide may be used for transportation. The length, width, and interior capacity of the container 10 with the internal lock mechanism 42 as described below are not limiting. Additionally, the type of product held by the containers is not limiting. For example, though a box container is generally described herein, the device may be used with bulk containers typically 20 to 28 feet long and/or tanks designed to hold liquids with a holding capacity of 4000-6000 gallons.

Referring back to FIG. 1, a container 10 comprises at least a top wall 12, a bottom wall 16, and side walls 14. A front wall and/or back wall may also be provided. In some cases, one or more doors 22 may be provided on a back end (e.g., forming or a part of a back wall) of the container 10. Alternatively, door(s) 22 may be provided on a front end or front wall of the container 10, for example. The at least one door 22 is movable between an open position and a closed position, thereby providing or preventing access to an interior of the container 10 (and any contents therein). The door(s) 22 may be provided within a door receiving space. In some cases, the door receiving space may be defined by the frame 17. The doors 22 may be hingedly mounted to the frame 17 via hinges 24, for example. The doors 22 are capable of movement or rotation between an open position and a closed position via rotation about vertical axis of hinges 24 within the door receiving space. The door receiving space is generally rectangular in construction as defined by the frame 17, for example. Each door 22 is also generally rectangular in construction, and extends between the top wall 12 and the bottom wall 16. Each door has a top or upper end 39 and a bottom or lower end 38.

In some cases, as is generally known in the art, a door 22 may include an outer panel and an inner panel (or walls), with a space therebetween defined by edges surrounding the upper end 39, sides, and bottom end 38. Generally, the space has as width that is defined by a measurement or distance between the outer panel and the inner panel. The lower or bottom end 38 of door 22 of FIG. 1 may also include a bottom edge 38*a*. A width of the bottom edge 38*a* may generally correspond to the width of the space between the outer panel and the inner panel. The space of the door 22 may have reinforcing materials therein, for example. Alternatively, in other cases, the door 22 may comprise a substantially solid or uniform structure. As such, the construction of the door should not be limiting.

In some cases, the container walls 12, 14, 16 (and front and back walls, if provided) may be connected by a frame 17 to form an enclosed box, for example. The frame 17 may assist in forming the container 10 enclosure with the walls 12, 14, 16 and one or more doors 22. The frame 17 comprises a sill 17*a* that is adjacent the bottom end 38 of the at least one door 22. The sill 17*a* includes a sill surface 36 on an upwardly facing edge thereof. When the door(s) 22 are in a closed position, the bottom edge 38*a* of each door 22 and the sill surface 36 are adjacent each other. In some cases, the width of the space between the panels of the at least one door 22 may correspond to the width of the sill surface 36.

It should be noted that, although not specifically shown in the Figures, the container doors 22 may include flanges and/or seals around the edges thereof and adjacent the frame 17 and/or sill 17*a*. As is known in the art, such devices may assist in sealing the door opening when the doors are in a closed position.

As previously noted, the doors 22 may provide or prohibit access to an interior of the container 10 and any contents therein. Specifically, when the doors 22 are in a closed position and locked using a locking device, one may be prevented from moving doors 22 to an open position about their hinges 24. FIG. 1 illustrates a common example of an external locking device 30 that may be used with the at least one door 22. In the depicted configuration, the external locking device 30 comprises a vertically extended and rotatable rod 32 on the external surface of each of the doors, that extends from the top end 39 of the door to the bottom end 38 of the door. The external locking device 30 may be in contact with or lock with respect to the frame 17. At least one end may be locked in the frame 17 or sill 17*a*, for example. Generally, the rod 32 cooperates with a plurality of receivers 34, and may be rotated about a vertical axis between an unlocked and locked position. Additional locks or devices may also be provided.

However, as noted above, external locking devices such as device 30 have their disadvantages, including, for example, easy access to the devices as well as providing greater ability for unlocking or breaking, and potential for damage.

Figure 2:
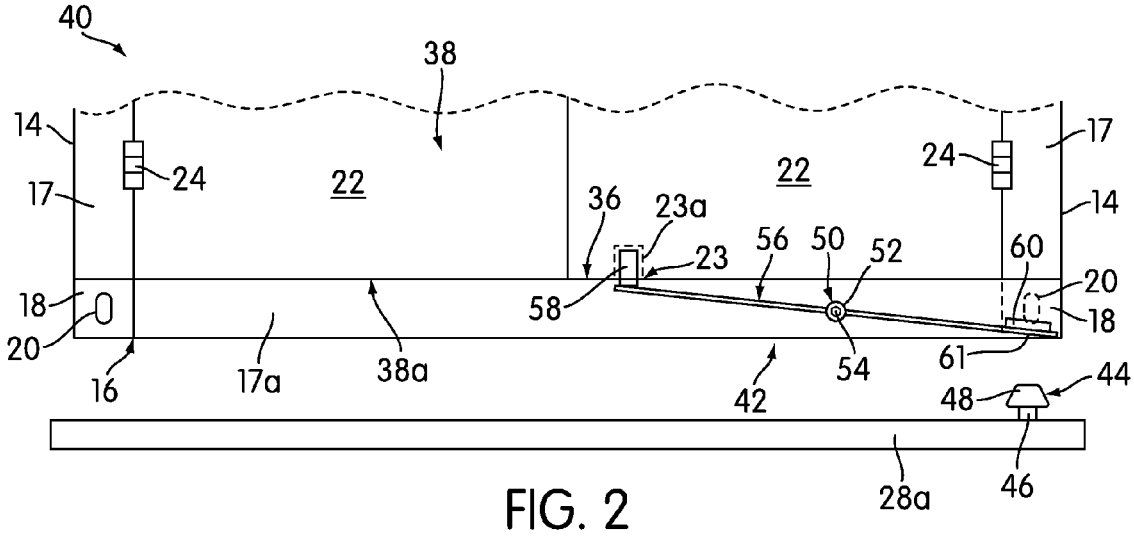
FIG. 2 is a partial end view of a container with an internal lock mechanism in accordance with an embodiment of the present invention.
Figure 3:
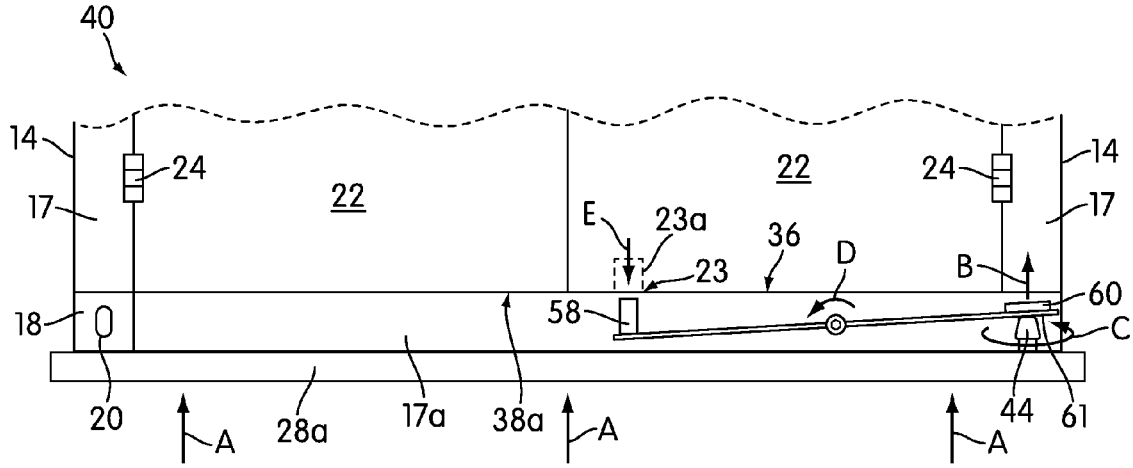
FIG. 3 is a partial end view of a container illustrating an unlocked position for the internal lock mechanism of FIG. 2 in accordance with an embodiment of the present invention.

As shown in FIGS. 2 and 3, in an embodiment in accordance with the invention, container 10 is provided with an internal lock mechanism 42 for the at least one door 22. For clarity purposes only, the internal lock mechanism 42 is shown on a right side of the container 10 and with respect to a right side door. However, it is to be understood that the left side of the container 10 may also include a left lock mechanism (substantially similar to internal lock mechanism 42) for the door on the left side.

At least a portion of the internal lock mechanism 42 is provided within the sill 17*a* of the container 10. As will become further evident, in this embodiment, the internal lock mechanism 42 may be normally biased toward a locked position when the at least one door is in a closed position. In this embodiment, for example, a lock member 58 of the internal lock mechanism 42 is biased toward the locked position.

More specifically, the internal lock mechanism 42 comprises a lock member 58 that is configured to move between (a) a locked position engaging the at least one door 22 to lock the at least one door 22 in the closed position (e.g., see FIG. 2), and (b) an unlocked position disengaged from the at least one door 22 to permit the at least one door 22 to move from the closed position to the open position (e.g., see FIG. 3). In some embodiments, the lock member 58 comprises a lock pin extending upwardly therefrom. For example, the lock pin may be biased upwardly in the sill 17*a* of the container 10 and into engagement with the at least one door 22 when in the locked position. In some instances, the lock member 58 may engage the door 22 internally between the walls or panels of the door. For example, as shown in FIGS. 2 and 3, the upwardly facing sill surface 36 of the sill 17*a* and the bottom edge 38*a* of the door 22 may comprise corresponding openings 23. The openings 23 are aligned when the door is in a closed position, and are configured to allow lock member 58 to extend therethrough. In some cases, the door 22 may comprise an internal space 23*a* for receiving the lock member 58 or pin.

The internal lock mechanism 42 further comprises a contact portion 61 for moving the lock member 58 or pin between the locked position and the unlocked position. The contact portion 61 may be accessible via an opening on a bottom of the container 10. Additionally, the contact portion 61 may be configured such that contact with the contact portion 61 by a contacting structure of an object 28 upon which the container stacks responsively moves the lock member 58 against its bias from the locked position to the unlocked position (thereby permitting movement of the at least one door 22 of the intermodal container from the closed position to the open position).

The opening on the bottom of the container 10 may be provided in any number of places. For example, in the embodiment shown in FIGS. 2 and 3, the opening is provided in a corner fitting 18 on the bottom of the container near the frame 17. It is generally known that a structure or frame 17 of the container 10 may be provided and designed to facilitate lifting and stacking For example, when using intermodal containers, each container may comprise corner fittings 18 at each corner, each of the corner fittings 18 comprising a plurality of connection openings 20 or apertures. The connection openings 20 may be provided on at least each of the sides (e.g., a front side, left/right side, bottom side) that are exposed, for example. The connection openings 20 are commonly used to connect or releasably lock a top container to the bottom container when mounted on each other to form a stack/double stack, for example (e.g., see FIGS. 4 and 5). The connection openings 20 may also be used to lift a container (such as to move container 10 throughout a yard or onto a device for mounting). The connection openings 20 of the corner fittings 18 comprise an opening, hole, or aperture for receiving a securing, clamping, or connecting device. The opening, hole, or aperture 20 may be circular, oval, or any other shape, although they are typically elongated in shape. The corner fittings 18 are also designed to meet ISO standards and/or specifications. The corner fittings 18 may be made from a number of materials including, but not limited to, aluminum, stainless steel, and carbon steel.

Figure 4:
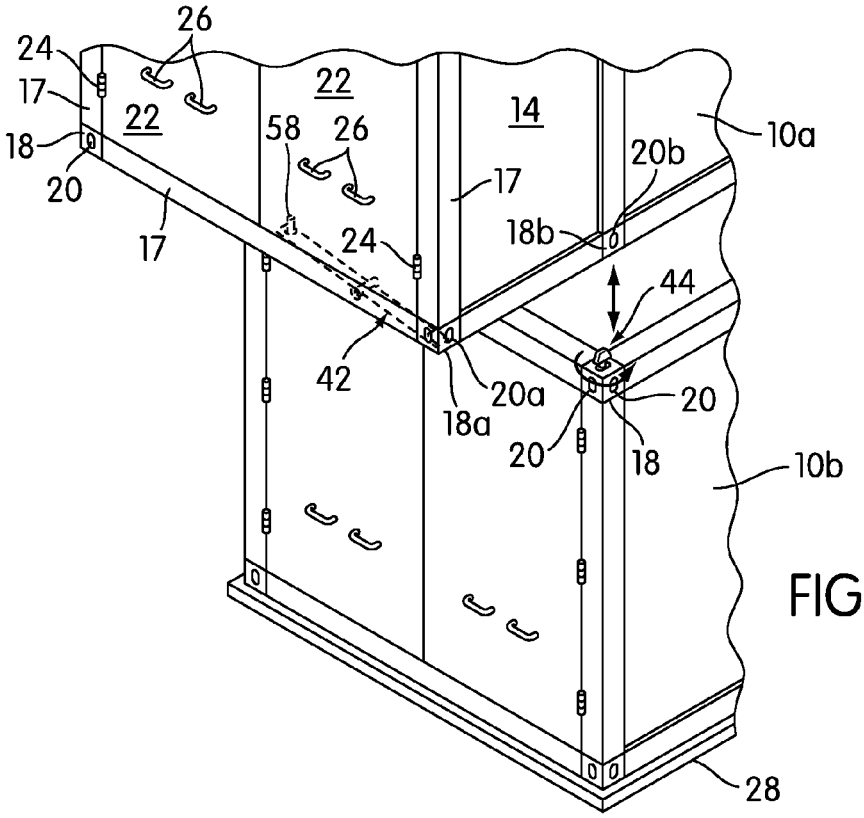
FIGS. 4 and 5 illustrate perspective views of a top container with the internal lock mechanism of FIG. 2 in a locked position before and after stacking on a bottom container in accordance with an embodiment of the present invention.
Figure 5:
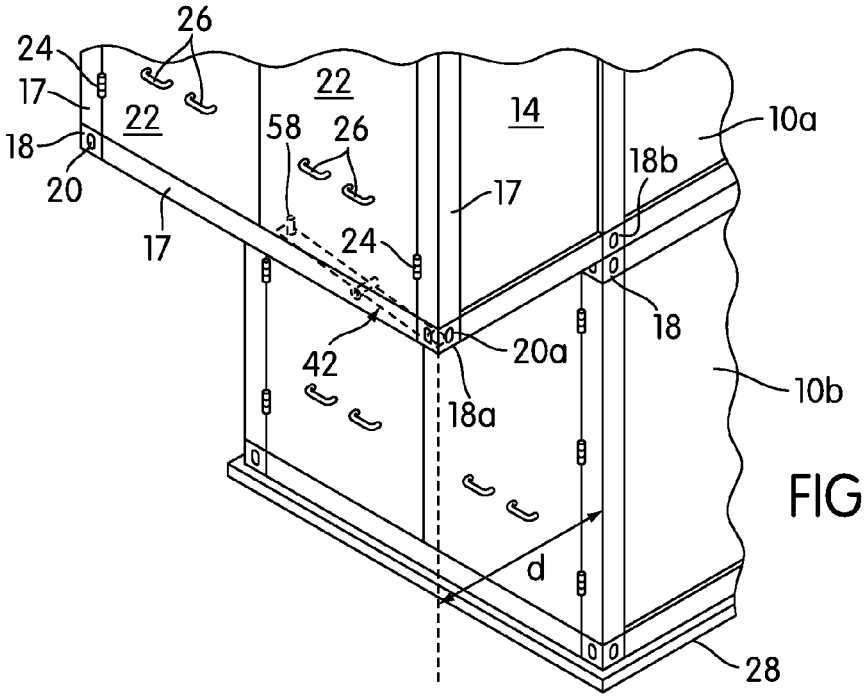

Generally, at least eight (8) corner fittings 18 are provided on a container (two top right, two top left, two bottom right, two bottom left). However, containers of larger length may include sixteen (16) fittings. For example, in some embodiments, containers of different dimensions may be used and or stacked. As shown in FIGS. 4 and 5, for example, a top container 10*a* having a different length than a bottom container 10*b* may form a set of containers for stacking in a well car. Forming such stacks is generally known in the art. Containers 10*a* of greater length therefore, generally comprise two sets of corner fittings 18*a* and 18*b*. Corner fittings 18*a* and 18*b* may be equivalent to corner fittings 18 as described above, and are generally known in the art. As shown in these Figures, corner fittings 18*b* are provided at a distance from the front or back wall (or doors 22) of the container that allows the top container 10*a* to be aligned and locked with the bottom container 10*b* via the fittings 18*b* and 18.

As such, in an embodiment, the contact portion 61 may be located internally above a bottom connection opening 20 of one of the corner fittings 18 such that contact with the contact portion is affected by the contacting structure extending upwardly through the bottom connection opening 20. That is, a downwardly facing or bottom opening 20 of the corner fitting 18 of the container 10 may allow a contacting structure access therein, such that contact may be made by the contacting structure with the contact portion 61 of the internal lock mechanism 42. In some embodiments, that contacting structure may be in the form of a rotatable lock device which extends up through the opening 20 and into contact with the contact portion 61. For example, the contact portion 61 may be contacted by a contacting structure in the form of at least one rotatable lock device for releasably securing the corner fittings 18 of the container 10 to an object 28 (e.g., an object upon which the container is stacked). In some cases, the object 28 may be at least a part of a chassis, rail car, or another container, for example. In order to lock a container to an object 28, or to lock a lift to a container, or to lock two intermodal containers together, it is commonly known to use devices known as twist locks 44. In accordance with embodiments, twist locks 44 may be the structure or rotatable device for moving the lock mechanism 42 to an unlocked position.

As shown in FIGS. 2 and 3, twist locks 44 may be provided on any type of object 28, including a chassis and a flatbed trailer. Twist locks are safety locking mechanisms and may be manually or automatically actuated. Twist locks are designed to be inserted into the connection openings 20 of corner fittings 18 of a container 10, for example, and are twisted or rotated to lock a head portion within the connection opening 20. Generally, the twist lock 44 has a shaft or rotatable base 46 with an elongated head 48 that is aligned with and is inserted into an opening 20 of the fitting 18. The rotatable base 46 comprises a rotatable shaft that is rotatable or pivotable in at least two directions about a substantially vertical axis. For simplicity purposes only, the base 46 is depicted as merely comprising a rotatable shaft. However, it should be noted that the rotatable base 46 may comprise any number of shapes, designs, parts, or other devices that may pivot or rotate about a substantially vertical axis, and should not be limited to the illustrated design. The rotatable base 46 or shaft is designed to be pivoted or rotated about the horizontal axis to rotate elongated locking head 48 between an unlocked position and a locked position.

The locking head 48 comprises a substantially tapered, oblong shape. The locking head 48 is designed such that it may be easily inserted into the connection openings 20 of the corner fittings 18 of a container. In some embodiments, the locking head 48 may be of substantially similar shape to that of the connection opening 20 of the corner fitting 18. Although the tapered, oblong shape of the locking head 48 assists in inserting and locking/pivoting in a corner fitting 18 to unlock the biased internal lock mechanism 42, the shape of the locking head 48 should not be limited. In some instances, the locking head 48 may also be considered a bayonet pin which is designed to rotate about an axis of 90 degrees, under the guidance of the rotatable base 46. For example, the locking head 48 may be rotated between an unlocked position (e.g., at zero degrees), and a locked position (e.g., at 90 degrees), or vice versa. In some embodiments, the shape of the locking head 48, such as its base, may be altered. For example, if the opening 20 and the base of the locking head 48 comprise a substantially oblong shape, the locking head 48 may be easily inserted therein. However, when the locking head 48 is rotated or twisted, its base may be shaped such that it prevents the head 48 from being removed or withdrawn from the opening 20.

In some embodiments, the rotatable locking device 44 or twist locks may be attached or integral to the object 28. In other embodiments, the device 44 may be attached to the object 28 and to the fitting 18 of the container 10. In some embodiments, the locking head 48 of the twist lock 44 may be manually actuated. The locking head 48 may be rotated from an unlocked position to a locked position, or vice versa, via a toggle arm, for example. It is also envisioned that the twist lock 44 may be automatically actuated, or, alternatively, have an assisted actuation (e.g. electromechanical) from an unlocked to a locked position, or vice versa. Thus, the actuation of the twist lock 44 should not be limited.

Referring back to FIGS. 2 and 3, the internal lock mechanism 42 is designed to utilize the corner fittings 18 of the container 10 for unlocking the normally biased mechanism 42 from a locked position to an unlocked position. More specifically, when a container 10 is aligned with and stacked on an object 28 (e.g., on a surface of the object), the corner fittings 18 of the container 10 are substantially unrestricted and provide accessible openings for securely mounting the twist locks 44 therein. Specifically, the holes or connection openings 20 of the corner fittings 18 provided on the bottom wall 16 are aligned with the object 28, and the at least one rotatable locking device 44 (e.g., twist lock) is positioned with a bottom opening 20 on the bottom wall 16 for releasably securing the corner fitting 18 to the object 28. The rotatable locking device 44 contacts the contact portion 61 of the internal lock mechanism 42 to move the lock member 58. Utilizing the corner fittings 18 for unlocking the internal lock mechanism 42 to an unlocked position is beneficial as the corner fittings 18 are existing devices, and only minor modification needs to be made to the container 10 and its frame 17/sill 17*a* to incorporate the mechanism 42.

In order to move or unlock the lock mechanism 42 to an unlocked position, the internal lock mechanism 42 may also be configured to rotate about at least one pivot point 50. The pivot point 50 may be provided by a pivot pin 52 which is pivotable about an axis (e.g., a horizontal axis). In an embodiment, the lock mechanism 42 may comprise an elongate lever mechanism 56 designed to pivot about the pivot point 50 of the pivot pin 52. The elongate lever mechanism 56 comprises a first end and a second end. The first end may comprise the lock member 58, and the second end may comprise the contact portion 61. The vertical lock pin or locking member 58 may be extending upwardly from the first end. As previously noted, the vertical lock pin 58 is biased upwardly in the sill 17*a* of the container 10 and into engagement with the at least one door 22 when in the locked position (e.g., through adjacent openings 23 in the sill 17*a* and bottom edge 38*a* of door 22).

As such, FIG. 3 shows the container 10 when stacked on a surface of an object 28. For illustrative purposes only, the object 28 of FIGS. 2 and 3 is referred to as a chassis 28*a*. The twist locks or rotatable locking devices 44 are inserted into the opening 20 on the bottom of the corner fittings 18 an upward direction as noted by arrows A. Alternatively, it is noted that the container 10 can be described as being mounted downwardly, in a direction opposite that of arrow A, onto the surface of the chassis 28*a*, while the twist locks 44 are inserted upwardly into the bottom openings 20 located on a bottom surface (e.g., along the bottom wall 16) of the container 10. In any case, the insertion of a twist lock 44 upwardly and into a bottom opening 20 causes the internal lock mechanism 42 in the sill 17*a* to rotate the pivot point 50 and pin 52 about a horizontal axis, as represented by arrow D. Specifically, the twist lock 44 contacts a second end of the elongate lever mechanism 56 and pushes it upwardly in a direction noted by arrow B, thereby causing pivotal motion about the pivoting point 50. The first end of the lever mechanism is correspondingly rotated downwardly in a downward direction towards sill 17*a*, as represented by arrow E, into the unlocked position. The lock member 58 or pin thus is moved downwardly and disengaged from the door 22 into the unlocked position. As such, the door 22 may be moved with respect to the door receiving space from the closed position to the open position.

The methods for biasing the internal lock mechanism 42 toward the locked position should not be limiting. For example, in an embodiment, a top or upper end of the second end of the lock mechanism 42 may comprise a biasing member in the form of a weight 60 for biasing the lock member 58 upwardly in an engaged position with the door 2. That is, as the second end of the lever mechanism 56 is pushed downwardly by the weight 60, the first end with the lock member 58 moves upwardly in direction B through the corresponding openings 23 and into the locked position. However, other methods or devices, such as springs, for example, may also be used to bias the lock member, and thus the biasing member used with internal lock mechanism 42 should not be limiting. Also, the amount of resistance for maintaining the lock mechanism 42 in a locked position (and thus preventing breach of the lock mechanism 42 during an attempted entry, for example) should also not be limiting. For example, in some embodiments, the biasing member or weight 60 may be configured with the lock mechanism 42 to provide approximately 350 pounds (lbs) to 3000 pounds (lbs) of resistance. Thus, any range of resistances may be incorporated into the lock mechanism 42 before the lock mechanism 42 is moved from a locked position to an unlock position.

Of course, the location of the opening on the bottom of the container that provides accessibility to the contact portion of the internal lock mechanism 42 should not be limiting. For example, in some embodiments, the opening may be provided in the sill 17*a*. That is, in some instances, a contact portion may be accessible through the sill 17*a*. In other instances, it is envisioned that the contact portion may at least partially extend from the sill 17*a*, i.e., the sill 17*a* may have a hole or opening for allowing the contact portion to extend downwardly out of the sill 17*a*, thereby allowing one to contact the contact portion and thereby move the lock mechanism 42 into an unlocked position.

In some cases, the contacting structure of an object for contacting contact portion on the bottom of the container may be a part of a chassis, rail car, or another container. For example, in the envisioned embodiment wherein the opening on the bottom of the container is provided in the sill 17*a*, the contact portion of the internal lock mechanism 42 may extend outwardly through the opening. In this case, when the container is stacked or placed on a chassis, rail car, or another container, the contact portion of the lock mechanism 42 may be positioned and configured such that the placement of the container on such a structure and/or object responsively moves the lock member 58 against its bias. That is, an edge, bar, beam, or other part of the chassis, rail car, or other container (i.e., the object upon which the container stacks) may be the contacting structure. As such, it is to be understood that "contacting structure" throughout this disclosure may be any part or object that may come into contact with the contact portion of the internal lock mechanism.

Though the internal lock mechanism 42 is described and shown as comprising an elongate lever mechanism designed to rotate about a pivot point 50, it is envisioned and within the scope of this invention that one or more alternate pivotable members may be used to hold or bias the internal lock mechanism 42 toward a locked position, and that such members are capable of movement into an unlocked position in accordance with an embodiment of this invention. For example, two or more lever mechanisms may be used. In some cases, the contact portion 61 may inhibit a pushing or pulling action on the internal lock mechanism 42. Alternatively, other combinations of structures or devices may be used.

The internal lock mechanism 42 thus provides several nonlimiting advantages. For example, the mechanism 42 is a mechanical lock mechanism, thus providing an economical choice when adding lock mechanisms to containers, as it may be purchased at lower cost. Additionally, because the internal lock mechanism 42 uses existing structures (e.g., sill 17*a*, corner fittings 18), the addition of such a device requires minor manipulation or workload for installation. Also, the internal lock mechanism 42 is out of visible sight, thereby deterring possibilities of breakage or damage, resulting in theft or unauthorized access.

The lock mechanism 42 may also deter entry into an intermodal (ISO) or EMPU container while located on another object 28 such as a well car, on a ground surface, or on top of another container of smaller size, because the locking mechanism is maintained in a locked position. Specifically, when using the corner fittings 18 to provide access to the contact portion 61, flat surfaces such as these do not necessarily provide a structure for contacting the contact portion 61. For example, a structure or a rotatable lock device 44 is not necessarily provided on such surfaces (e.g., the locking head may be designed differently, or not provided at all). Thus, no feature or appropriate activation device may be provided to contact and therefore the locking mechanism 42 from the locked position to the unlocked position.

Additionally, if the locking mechanism 42 is provided on an intermodal container 10*a* of longer length (e.g., a container 10 having a length of approximately 48 feet or approximately 53 feet) which is stacked on an intermodal container 10*b* of shorter length (e.g., a container 10 having a length of approximately 40 feet), the twist locks or rotatable locking devices 44 used to attach the containers together would not disengage the lock member 58 of the mechanism 42 from the door(s) 22 of the top container 10*a*. Generally the use of stacked (or "double stacked") intermodal containers, wherein a top container 10*a* is mounted on a bottom container 10*b*, is known as a method of transporting goods on rail. For example, a series of stacked intermodal containers may be provided on stack cars and pulled by a locomotive along a rail to form a train used for transporting goods on land. The mounting and/or locking of top and bottom containers 10*a* and 10*b*, respectively, to each other in a stack is generally known in the art.

Specifically, as shown in FIGS. 4 and 5, the top container 10*a* of longer length comprises a first set 18*a* and a second set 18*b* of corner fittings. As noted above, containers of larger length may include sixteen (16) fittings. When a top container 10*a* of greater length is stacked upon the bottom container 10*b*, therefore, the second set of fittings 18*b* are aligned with corner fittings 18, and rotatable locking devices 44 are positioned and locked therein. An end of the top container 10*a* generally extends a distance d from an end of the bottom container 10*b*. The structures or rotatable locking devices 44 for this connection engage the second set 18*b* of bottom connection openings 20*b*, not the first set 18*a* of corner fittings at the ends of the container, adjacent the at least one door 22. As such, the lock member 58 of the internal lock mechanism 42 remains biased in the locked position. This further deters theft and entry into the interior of the container 10*a*, such as when stacks of containers are being transported in well cars.

In some instances, the interior of a container or its contents may need to be accessed and the door(s) 22 may need to be opened with respect to the door receiving space. Alternatively, since the lock mechanism 42 is biased upwardly, the door(s) 22 may need to be closed from an open position to a closed position. As such, in an embodiment, a tool or mechanism may be used to at least temporarily unbias the lock mechanism 42 from its locked position. FIGS. 6-9 illustrate an example embodiment of a manual override feature 62 (and its method of use) for the lock mechanism 42, that moves the lock mechanism 42 against its bias from the locked position to the unlocked position, and allows access to the container 10 in the event of inspection, derailment or other reason for access to the container 10 (or, alternatively, allows closing of door(s) 22). Of course, it is envisioned that several types or methods for overriding the bias of the locking mechanism 42 may be provided, including mechanical, electro-mechanical, or electrical devices. Additionally, activation for using such devices may be provided in any number of locations. For example, if using an electro-mechanical override device, an activation system in a remote location from the container may enable movement of the lock member 58 from engaging the door. In any case, the override feature 62 as described herein is not meant to be limiting. Furthermore, an override feature or mechanism need not be provided.

The manual override device 62 as shown and described in this embodiment may be used with an internal lock mechanism 42 comprising a lever mechanism 56. Generally, in this embodiment, the override device 62 is provided in the form of a handle that is configured to move the lock member 58 against its bias from the locked position to the unlocked position. In some embodiments, the handle could be articulated to fold under the container and/or be operable only while on a surface. In some cases, in order to obtain access to a handle, a key or similar device may be used to allow removal and application of such an override device 62. In some cases, the override device 62 may be in the form of a removable turn handle 68 that is removably attached to the internal lock mechanism 42.

In an embodiment, the internal lock mechanism 42 comprises a key shaped receiving portion, and the override device 62 comprises a complimentary key portion for placement into the key receiving portion. For example, as shown in detail in FIG. 7, the override device 62 may comprise an elongate shaft 64 having a shaped configuration that acts as a key portion for moving the internal lock mechanism 42. The shaped configuration may be any type of unique design or pattern or any number or combination of shapes, and should not be limiting. More specifically, the shaped configuration of the shaft 64 should be complimentary to that of the key receiving portion 54. Specifically, the pivot point 50 and/or its pivot pin 52 may comprise a key-receiving opening 54 having internal shaped walls for receiving the shaft 64. An override device 62 with a key-type configuration is advantageous as it may be used to restrict access to those identified personnel and prevent unauthorized access by others without such a device into the container.

Figure 6:
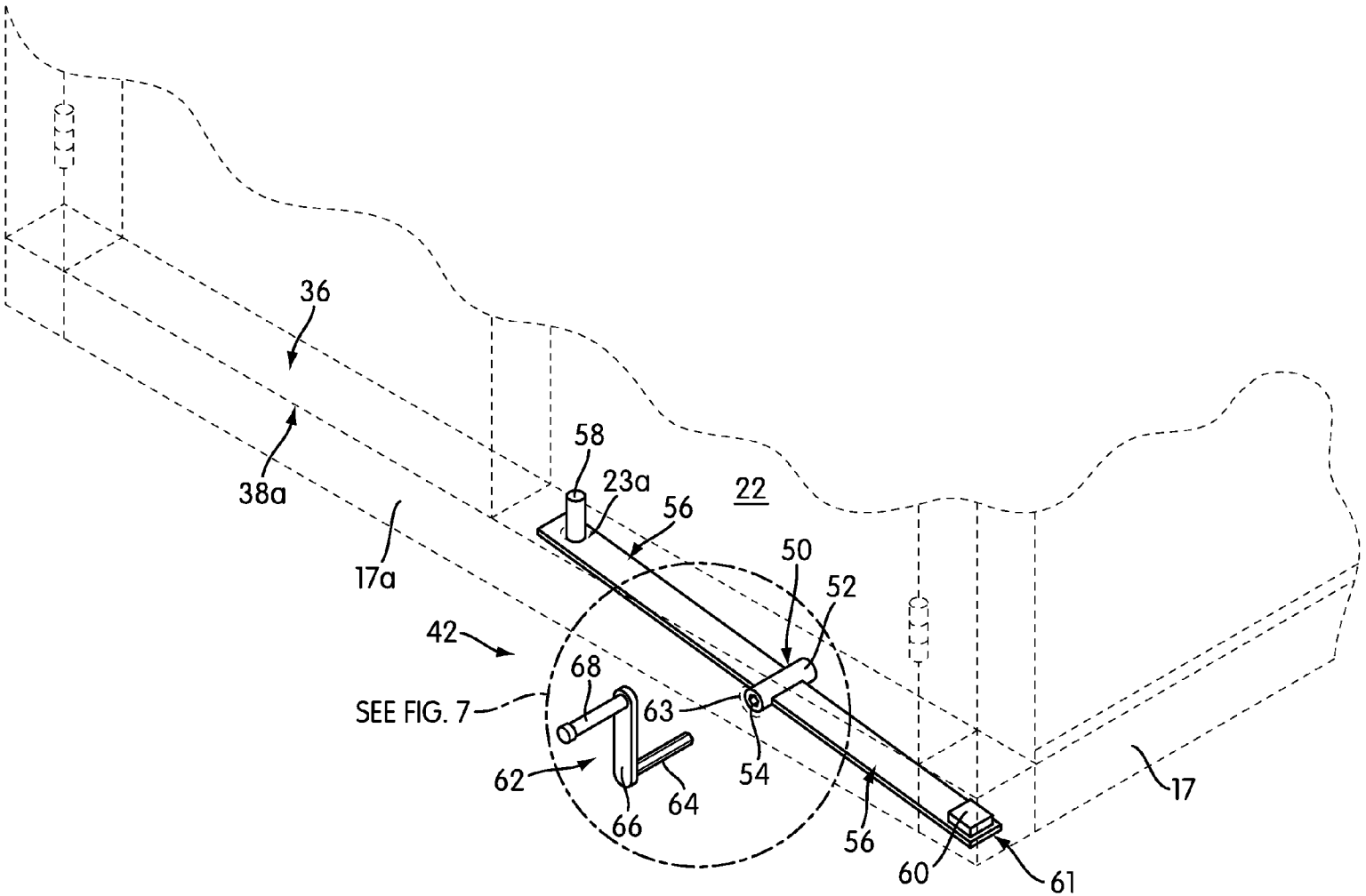
FIG. 6 illustrates a perspective view of the internal lock mechanism and an override feature in accordance with an embodiment of the present invention.
Figure 7:
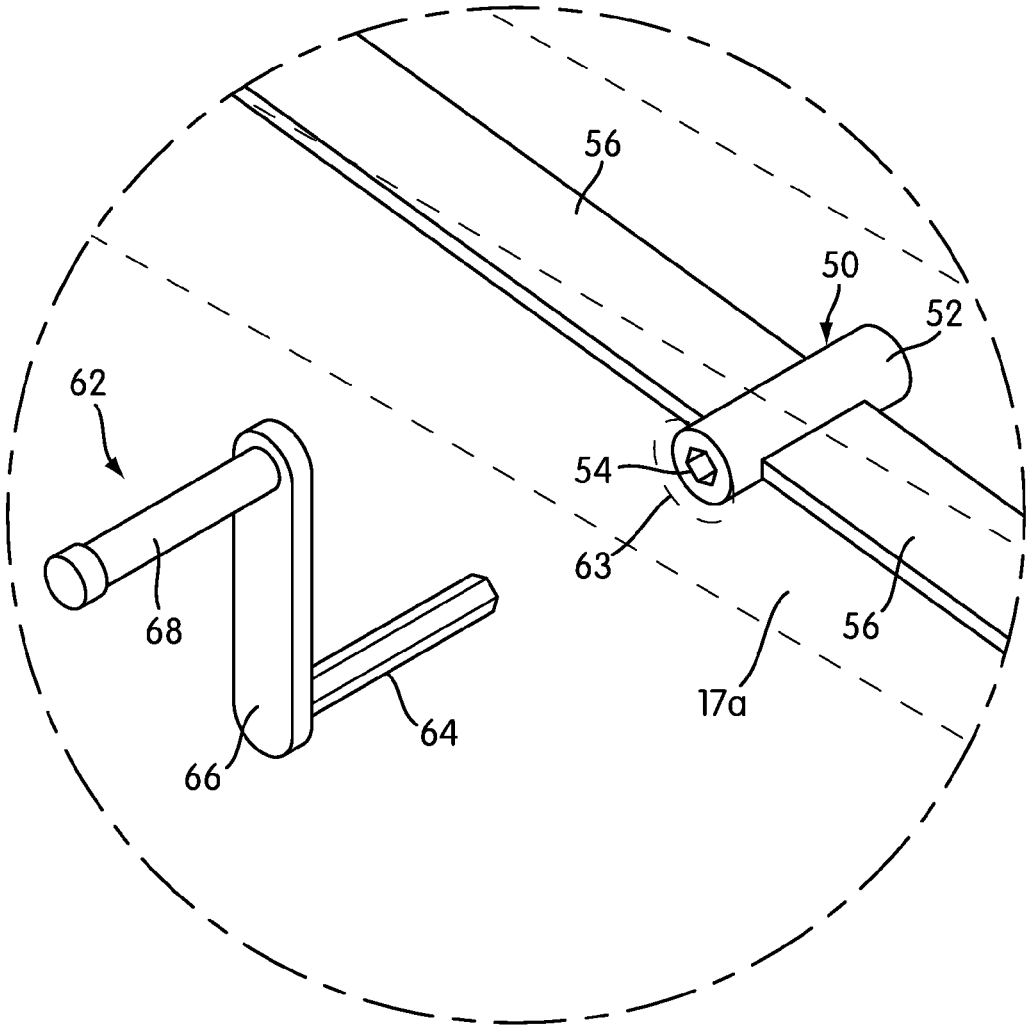
FIG. 7 illustrates a detailed view of the override feature of FIG. 6.

As shown, the shaft 64 may be attached to an extension piece 66 and a handle 68 to form a structure which may assist in movement the lock mechanism 42. The override device 62 may be connected to the internal lock mechanism 42 by inserting the shaft 64 into a hole or opening 63 in the container 10. For example, as shown in FIGS. 6-7, a hole or opening 63 is provided on a front face or surface of the sill 17*a*. Of course, it is envisioned, in some embodiments, that such a hole or opening may also be provided on a side or underside (bottom) surface. Insertion through the hole or opening 63 allows personnel to insert the shaft 64 into the key receiving portion 54. The handle 68 and extension piece 66 assist in moving the lock member 58 from engagement with the door.

Figure 8:
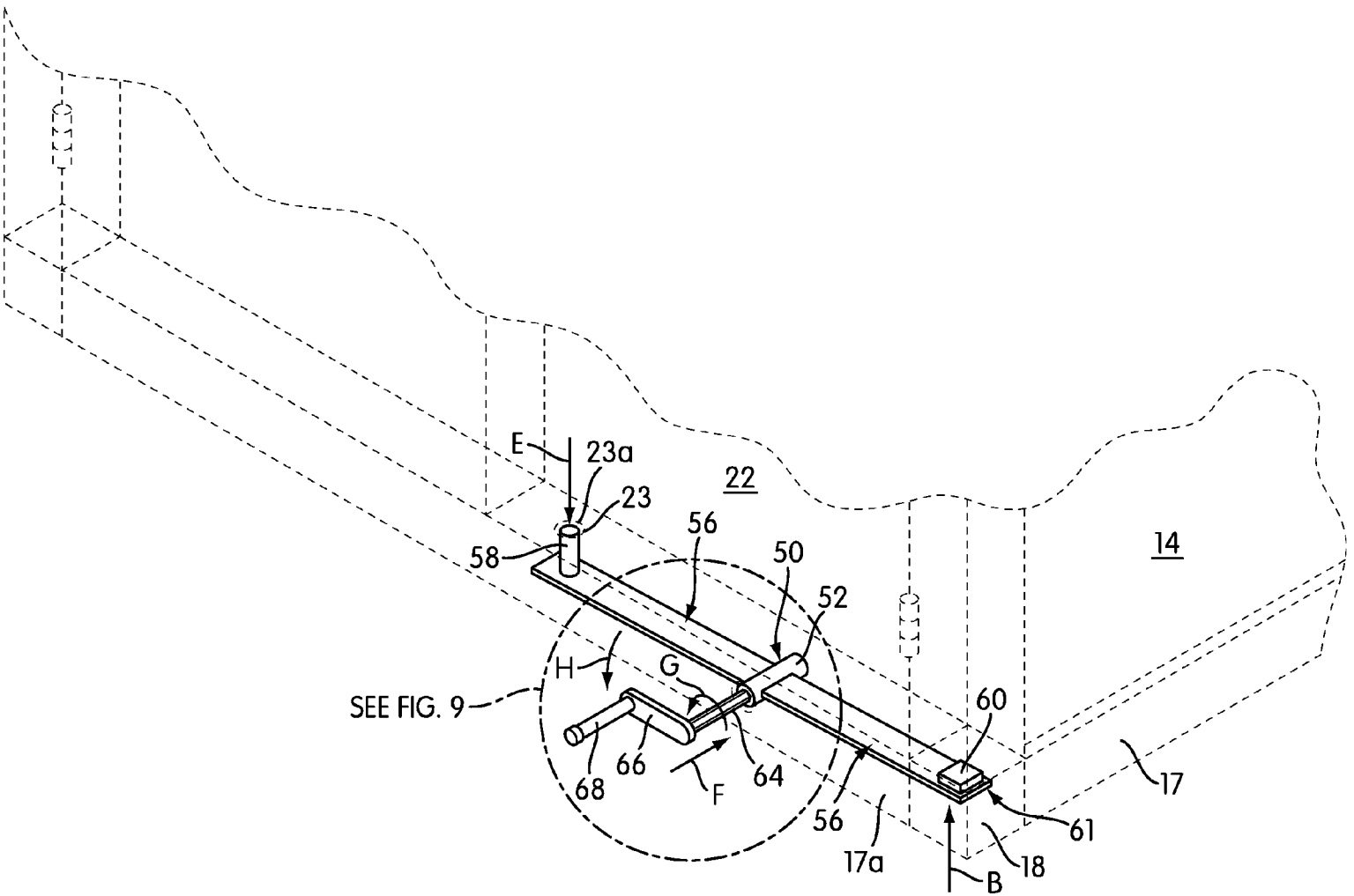
FIG. 8 illustrates a perspective view of the use of the override feature in accordance with an embodiment of the present invention.
Figure 9:
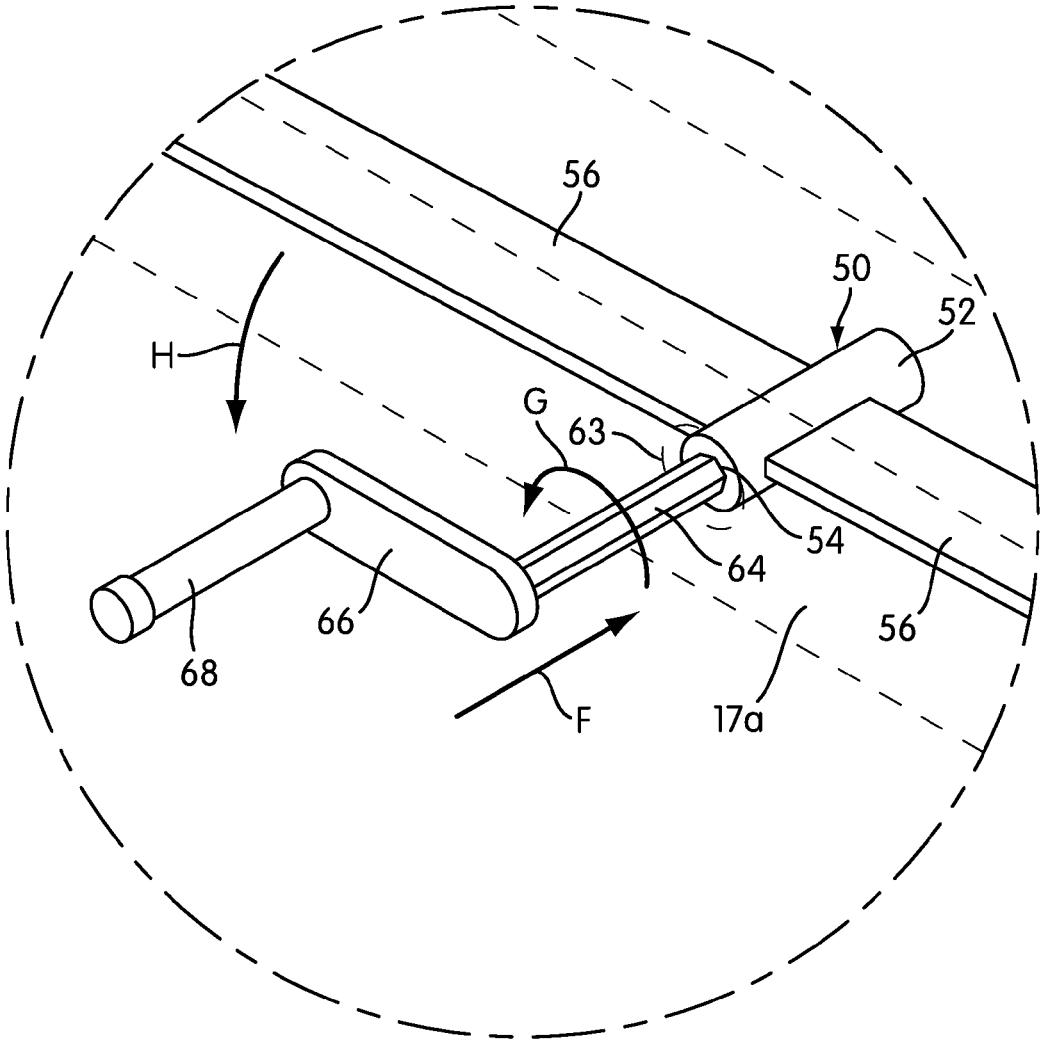
FIG. 9 illustrates a detailed view of using the override feature of FIG. 8.

More specifically, as shown in FIGS. 8 and 9, the elongate shaft 64 is inserted through the hole 63 and into the key receiving portion 54 of the lever mechanism 56, as represented by arrow F. A rotating force is then applied about the axis as indicated by arrow G to rotate the shaft 64 by applying force to the handle 68 rotationally in the direction as indicated by arrow H. As such, the pivot pin 52 rotates in a similar direction as noted by arrow G about its axis, thereby moving the lock member 58 downward in a direction E out of openings 23/23*a* and into the sill 17*a*. Thus, the lock member 58 is disengaged from the door 22 and the door 22 may be opened.

Figure 10:
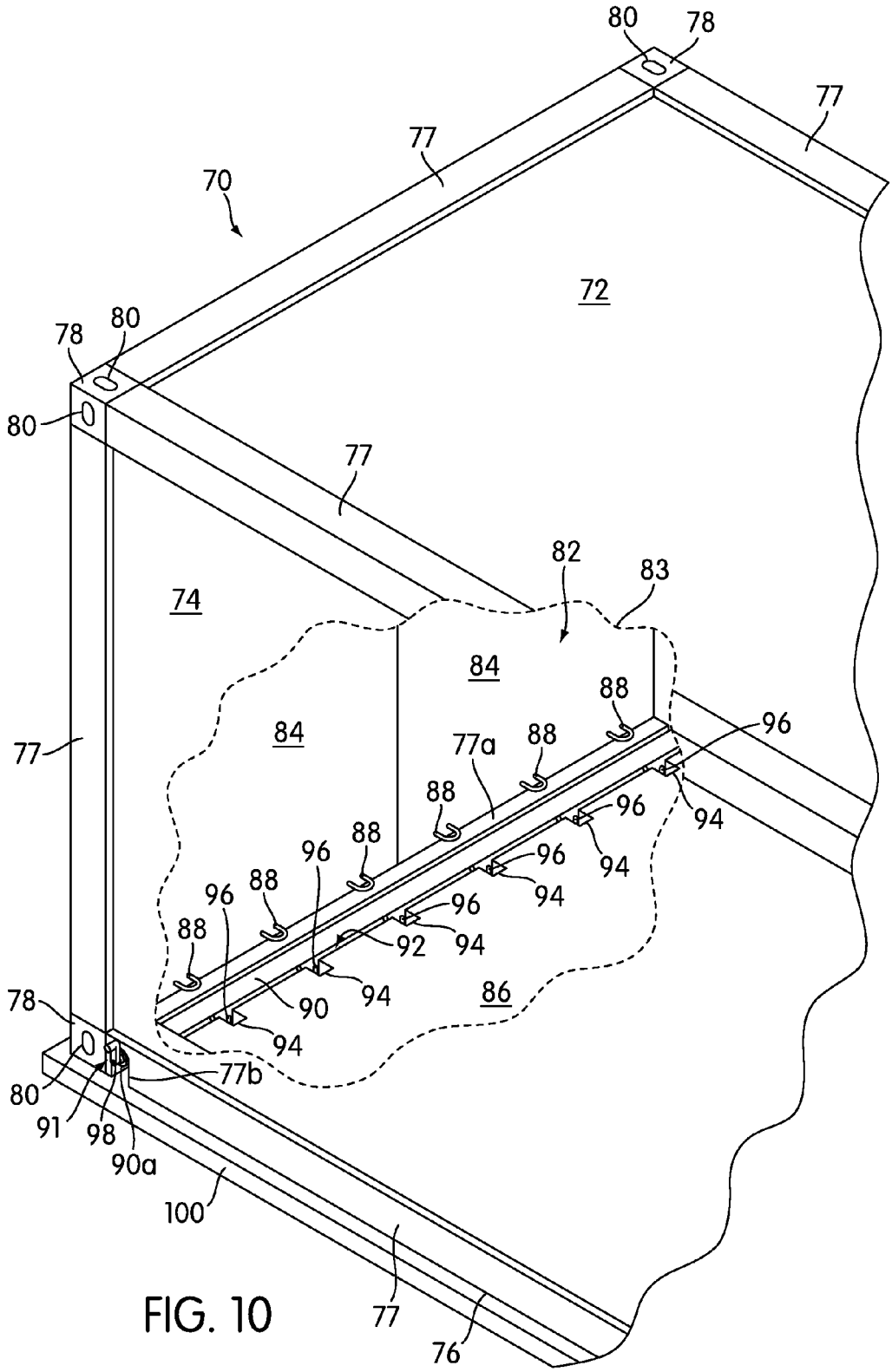
FIG. 10 illustrates a perspective view of a container including a cut-away view of an inside of the container including an internal lock mechanism in an unlocked position in accordance with another embodiment of the present invention.
Figure 11:
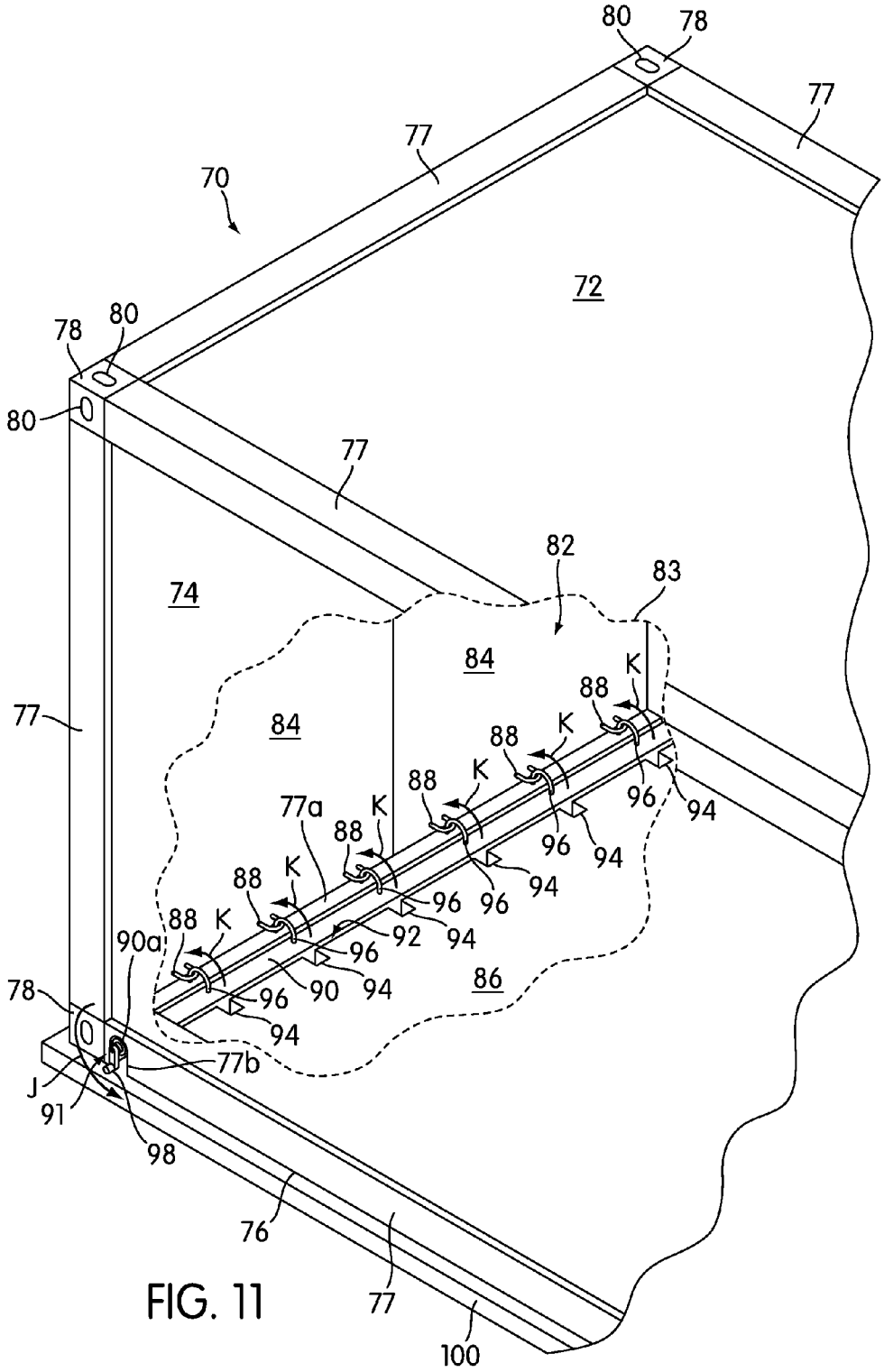
FIG. 11 illustrates a perspective view of the internal lock mechanism of FIG. 10 in a locked position in accordance with an embodiment of the present invention.

FIGS. 10 and 11 illustrate an internal lock mechanism 82 in an unlocked position and locked position, respectively, in accordance with another embodiment of the present invention. Again, the internal lock mechanism 82 is designed such that it prevents opening of the doors 84 and access to the contents in the containers 70 (e.g., by intruders or thieves).

Generally, speaking the container 70 as shown in FIGS. 10 and 11 comprises similar features as described with respect to FIGS. 1-3. The container 70 comprises at least a top wall 72, a bottom wall 76, side walls 76, and/or front and back walls. At least one door 84 and a sill 77*a* adjacent a bottom end of the at least one door 84—which may be a part of a frame 77 for forming the enclosure of the container 70—is also provided. The at least one door 84 is movable between an open position and a closed position in the door receiving space.

The internal locking mechanism 82 for the at least one door 84 in this embodiment comprises at least one lock member 96 configured to move between (a) a locked position engaging the at least one door to lock the at least one door 22 in the closed position (e.g., see FIG. 11) and (b) an unlocked position disengaged from the at least one door 22 to permit the at least one door to move from the closed position to the open position (e.g., see FIG. 10). More specifically, the views of FIGS. 10 and 11 illustrate a cut-out portion 83 showing an interior of the container 70. In this embodiment, a movable portion of the internal lock mechanism 82 is provided adjacent to the sill 77*a* and within the interior 83 of the intermodal container 10. Specifically, the internal lock mechanism 82 comprises a plurality of locking hooks 96 and a plurality of locking hook receiving members 88 for interengaging one another, and which are provided within the interior (shown via cut-out portion 83) of the intermodal container on the movable portion and the at least one door 84.

As shown in this embodiment, the plurality of locking hook receiving members 88 may be provided along inside portion of the bottom end of the at least one door 84. In some cases, at least one hook receiving member 88 is provided on the interior side of the bottom end of the door 84. The one or more hook receiving member(s) 88 may be provided in a spaced configuration at any distance from each other and should not be limiting.

It should be noted that the shape and design of the hooks 86 and hook receiving members 88 should not be limiting. For example, the hook receiving members 88 of FIG. 10 are shown as closed loops whose ends are secured with respect to the door. However, it is envisioned that the hook receiving members 88 may comprise other shapes which may include an open end (i.e., members 88 may also be hooks) or alternative shapes (e.g., polygonal).

The plurality of locking hooks 96 may also be provided within the interior (see cut-out portion 83) of the intermodal container 10. Specifically, the plurality of locking hooks 96 are configured to engage the plurality of locking hook receiving members 88 when moved into the locked position and configured to disengage the plurality of locking hook receiving members 88 when in the unlocked position. That is, the movable portion of the internal lock mechanism 82 is movable between (a) a locked position interengaging the hooks 86 and hook receiving portions 88 to lock the at least one door 84 in the closed position and (b) an unlocked position disengaging the hooks 86 and hook receiving portions 88.

The locking hooks 96 may be hidden from visible sight until they are required for use. For example, as shown in FIG. 10, the locking hooks 96 may be provided within a floor opening 92 comprising a plurality of areas 94 for retaining hooks 96 therein. The floor opening 92 is provided within the floor 86 of the interior of the container 10, adjacent the sill 17*a* and door receiving opening.

In embodiments, the internal lock mechanism 81 may further comprise a manual activation mechanism 91. The activation mechanism 91 may move the movable portion (e.g., including the locking hooks 86) between the unlocked position and the locked position. In the embodiment shown in FIGS. 10 and 11, the activation mechanism 91 is used to move a movable portion which comprises a rotatable shaft or lock rod 90 provided within a bottom wall or floor of the container. The plurality of locking hooks 96 may be provided on the lock rod 90 within the bottom wall or floor of the interior of the container 10. In this case, rotation of the rotatable shaft or lock rod 90 about its axis may move the plurality of locking hooks 96 between the locked position and the unlocked position. These Figures show the hooks 96 being moved out of an unlocked position (i.e., moved from being retained in the areas 94 of the floor opening 92).

To move the lock rod 90 and thus locking hooks 96 between the unlocked and locked position, a handle 98 may be provided. The handle 98 may be attached to the lock rod 90, for activating movement of the lock rod 90. In an embodiment as shown in FIGS. 10 and 11, the handle 98 is attached to an end 90*a* of the locking rod 90. In some cases, the handle 98 may be provided on or accessible via an exterior of the container walls, thereby allowing personnel to place the one or more door(s) 84 in a closed position in the door receiving space and then place the internal lock mechanism 82 into a locked position.

As shown in FIG. 11, after the doors 84 are closed, the handle 98 is rotated, as indicated by the arrow J, to thereby rotate the lock rod 90 about its axis. The locking hooks 96 are then also rotated about the axis of the lock rod 90 and out of the areas 94 of the floor opening 92 of floor 86, as indicated by arrow K, and into engagement with the locking hook receiving members 88 on the doors 84. The doors 84 are then internally locked in the locked position. Of course, although not shown in detail, the handle 98 and lock rod 90 may be rotated in an opposite direction as indicated by arrow J, for purposes of disengaging the hooks 96 from the hook receiving members 88, or, alternatively, for changing the direction of rotation of the lock rod 90 for engagement/disengagement, for example.

The internal lock mechanism 82 thus provides several non-limiting advantages. For example, the mechanism 82 is a mechanical lock mechanism, thus providing an economical choice when adding lock mechanisms to containers, as it may be purchased at lower cost. Additionally, because the internal lock mechanism 82 uses existing structures (e.g., sill 77*a*, floor 86), the addition of such a device requires minor manipulation or workload for installation. Also, the internal lock mechanism 82 is visibly out of sight, thereby deterring possibilities of breakage or damage, resulting in theft or unauthorized access.

The lock mechanism 82 may also deter entry into an intermodal (ISO) or EMPU container while located on another object such as a well car, on a ground surface, or on top of another container, because the locking mechanism is inaccessible from an exterior of the container 70. Specifically, when using the activation mechanism 91 and/or handle 98, one is required to have the appropriate structure to move the locking mechanism 82 from the locked position to the unlocked position. The above-described features of the internal lock mechanism 82 limit the methods for access to the container 70.

Additionally, in this embodiment, the handle 98 may be articulated to fold under the container 70 and/or be operable only while on an object. In some cases, in order to obtain access to a handle, a key or similar device may be used to allow removal and application of the handle 98. In some cases, the handle 98 may be in the form of a removable turn handle that is removably attached to the end 90*a* of the lock rod 90 of the internal lock mechanism 82.

In an embodiment, the internal lock mechanism 82 comprises a key shaped receiving portion, and the handle 98 comprises a complimentary key portion for placement into the key receiving portion. For example, the handle 98 may have a shaped configuration that acts as a key portion for moving the internal lock mechanism 82. The shaped configuration may be any type of unique design or pattern or any number or combination of shapes, and should not be limiting. More specifically, the shaped configuration of the handle 98 should be complimentary to that of the key receiving portion. Specifically, the end 90*a* of the lock rod 90 may comprise a key-receiving opening receiving a portion of the handle 98. An optionally removable handle 98 with a key-type configuration is advantageous as it may be used to restrict access to those identified personnel and prevent unauthorized access by others without such a device into the container 70.

Of course, it is to be understood that a manual or mechanical activation mechanism 91 need not be used with the internal lock mechanism 81 of FIGS. 10 and 11. Rather, or additionally, an electrical or electromechanical mechanism may also be used. For example, it is envisioned to be within the scope of the invention that the internal lock mechanism 82 may be used with a remotely-activated electrical device that is designed to initiate rotation of the lock rod 90 and the locking hooks 86 into a locked position. As such, the use of the activation mechanism 91 as shown should not be limiting.

While the principles of the invention have been made clear in the illustrative embodiments set forth above, it will be apparent to those skilled in the art that various modifications may be made to the structure, arrangement, proportion, elements, materials, and components used in the practice of the invention. For example, the door, door receiving opening, its dimensions (i.e., the space between the outer wall and the inner wall), and its materials are not to be limiting. Furthermore, the floor strength, thickness, design, and materials (e.g., metals such as aluminum or steel) used for the containers 10, 70 and internal locking mechanisms 42, 82 should not to be limiting.

Additionally, doors may also be provided on one or more of the sides of the container. Furthermore, it is to be understood that it is within the scope of this invention that the internal locking mechanisms 42, 82 may not only be provided in or adjacent the frame 17 or sill 17*a* on the back end of the container, but also in or adjacent the frame 17 or sill 17*a* on a front end and/or the sides, or any other location in the sill 17*a* adjacent a lower end of the at least one door location.

It is to be understood that springs or other similar devices may be used with the internal lock mechanism 42, 82 described herein.

Also, it is noted that the directions and ranges of which the devices may twist, rotate, or pivot about axes should not be limiting. In some embodiments, one or more devices may be provided on or within the frame 17 or sill 17*a* to further prevent movement of the internal lock mechanisms 42, 82 from moving from a locked position. Such preventive device (s) could be advantageous during movement or transport of containers 10, 70 or of stacks by trucks or a train, for example, as some movements may accidentally or inadvertently rotate or unlock the mechanisms 42, 82.

Further, it is noted that it is not beyond the scope of this invention that an electronic or electrical device may be used in combination with the internal lock mechanism 42. For example, an additional electrical device may be used to lock the doors 22. Also, an electronic override device may be used, for example. Additionally, both an internal lock mechanism such as 42 or 82 and an external locking device such as device 30 may also be used on a container.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. An intermodal container comprising:

at least a top wall, a bottom wall, side walls, at least one door and a sill adjacent a bottom end of the at least one door;

the at least one door being movable between an open position and a closed position;

an internal lock mechanism for the at least one door, the internal lock mechanism comprising a lock member configured to move between (a) a locked position engaging the at least one door to lock the at least one door in the closed position and (b) an unlocked position disengaged from the at least one door to permit the at least one door to move from the closed position to the open position, the lock member being biased toward the locked position;

at least a portion of the internal lock mechanism being provided within the sill of the intermodal container;

the internal lock mechanism further comprising a contact portion for moving the lock member between the locked position and the unlocked position, the contact portion being accessible via an opening on a bottom of the container, and wherein the contact portion is configured such that contact with the contact portion by a contacting structure of an object upon which the container stacks responsively moves the lock member against its bias from the locked position to the unlocked position, thereby permitting movement of the at least one door of the intermodal container from the closed position to the open position.

2. A container according to claim 1, wherein the opening is provided in the sill.

3. A container according to claim 1, further comprising corner fittings at each corner, each of the corner fittings comprising a plurality of connection openings, and wherein the contact portion is located internally above a bottom connection opening of one of the corner fittings such that contact with the contact portion is affected by the contacting structure extending upwardly through the bottom connection opening.

4. A container according to claim 1, wherein the internal lock mechanism is configured to rotate about at least one pivot point when moving between the locked position and the unlocked position.

5. A container according to claim 1, wherein the lock mechanism comprises an elongate lever mechanism, the elongate lever mechanism having a first end and a second end; the first end comprising the lock member and the second end comprising the contact portion.

6. A container according to claim 5, wherein the lock member is a vertical lock pin extending upwardly from the first end, and wherein the vertical lock pin is biased upwardly in the sill of the container and into engagement with the at least one door when in the locked position.

7. A container according to claim 1, wherein the lock member comprises a lock pin extending upwardly therefrom, and wherein the lock pin is biased upwardly in the sill of the container and into engagement with the at least one door when in the locked position.

8. A container according to claim 1, further comprising an override device comprising a removable handle that is removably attached to the internal lock mechanism, the override device configured to move the lock member against its bias from the locked position to the unlocked position; wherein the internal lock mechanism comprises a key shaped receiving portion, and wherein the removable handle comprises a complimentary key portion for placement into the key receiving portion.

9. A method for unlocking a door of an intermodal container, the intermodal container comprising at least a top wall, a bottom wall, side walls, at least one door and a sill adjacent a bottom end of the at least one door; the at least one door being movable between an open position and a closed position; an internal lock mechanism for the at least one door, the internal lock mechanism comprising a lock member configured to move between (a) a locked position engaging the at least one door to lock the at least one door in the closed position and (b) an unlocked position disengaged from the at least one door to permit the at least one door to move from the closed position to the open position, the lock member being biased toward the locked position; at least a portion of the internal lock mechanism being provided within the sill of the intermodal container; the internal lock mechanism further comprising a contact portion for moving the lock member between the locked position and the unlocked position, the contact portion being accessible by a contacting structure of an object via an opening on a bottom of the container, the method comprising:

stacking the container on the object;

contacting via the opening the contact portion of the internal lock mechanism using the contacting structure, and moving the lock member from the locked position to the unlocked position, thereby permitting movement of the at least one door of the intermodal container from the closed position to the open position.

10. The method according to claim 9, wherein the intermodal container further comprises corner fittings at each corner, each of the corner fittings comprising a plurality of connection openings, and wherein the method further comprises:

contacting the contact portion through one of the connection openings of the corner fittings, such that contact with the contact portion is affected by the contacting structure extending through the one of the connection openings.

11. The method according to claim 9, further comprising rotating the internal lock mechanism about at least one pivot point when moving the lock member between the locked position and the unlocked position.

12. The method according to claim 10, wherein the contacting structure comprises at least one locking device, and wherein the method further comprises:

aligning the connection openings of the corner fittings with the at least one locking device of the object;

positioning the at least one locking device within one of the connection openings for releasably securing the corner fittings of the intermodal container to the object, and wherein the at least one locking device contacts the contact portion of the internal lock mechanism to move the lock member.

13. The method according to claim 12, wherein the object is at least a part of a chassis, rail car, or another container.

14. The method according to claim 9, wherein the object is at least a part of a chassis, rail car, or another container.

15. The method according to claim 9, further comprising moving a lock pin of the lock member from the biased locked position to the unlocked position.

16. The method according to claim 9, further comprising placing an override device with a complimentary key portion within a key shaped receiving portion of the internal lock mechanism to move the lock member against its bias from the locked position to the unlocked position, and moving the override device.

17. An intermodal container comprising:

at least a top wall, a bottom wall, side walls, at least one door and a sill adjacent a bottom end of the at least one door;

the at least one door being movable between an open position and a closed position;

an internal locking mechanism for the at least one door, the internal locking mechanism comprising at least one lock member configured to move between (a) a locked position engaging the at least one door to lock the at least one door in the closed position and (b) an unlocked position disengaged from the at least one door to permit the at least one door to move from the closed position to the open position;

a movable portion of the internal lock mechanism being provided adjacent to the sill and within the interior of the intermodal container;

the internal lock mechanism further comprising a plurality of hooks and a plurality of hook receiving members for interengaging one another, the plurality of hooks and the plurality of hook receiving members provided within the interior of the intermodal container on the movable portion and the at least one door;

the movable portion being movable between (a) a locked position interengaging the hooks and hook receiving portions to lock the at least one door in the closed position and (b) an unlocked position disengaging the hooks and the hook receiving portions, and an activation mechanism for moving the movable portion between the unlocked position and the locked position.

18. The container of claim 17, wherein the activation mechanism comprises a rotatable shaft provided within the bottom wall of the intermodal container, the plurality of hooks being provided on the rotatable shaft, and wherein rotation of the rotatable shaft about its axis moves the plurality of hooks between the locked position and the unlocked position.

19. The container of claim 18, wherein the activation mechanism further comprises a handle that is attached to the rotatable shaft for activating movement of the rotatable shaft.

20. The container of claim 19, wherein the handle is accessible via an exterior of the container walls.

* * * * *